US008083126B2

(12) United States Patent
Fleming et al.

(10) Patent No.: US 8,083,126 B2
(45) Date of Patent: Dec. 27, 2011

(54) HAND CARRIER

(76) Inventors: Jack Alan Fleming, Hickory Corners, MI (US); Marion Jack Fleming, Galesburg, MI (US)

( * ) Notice: Subject to any disclaimer, the term of this patent is extended or adjusted under 35 U.S.C. 154(b) by 307 days.

(21) Appl. No.: 12/283,496

(22) Filed: Sep. 13, 2008

(65) Prior Publication Data

US 2010/0108748 A1 May 6, 2010

(51) Int. Cl.
*B65D 5/462* (2006.01)
*A45F 5/00* (2006.01)

(52) U.S. Cl. ..... 229/117.14; 206/194; 206/199; 206/485; 294/152

(58) Field of Classification Search ..... 229/117.11, 229/117.12, 117.13, 117.14, 87.04, 87.08; 206/162–191, 194, 198, 199, 427, 434, 485, 206/485.1; 294/152
See application file for complete search history.

(56) References Cited

U.S. PATENT DOCUMENTS 2,115,782 A * 5/1938 Mulnix ..... 229/117.13
2,324,771 A * 7/1943 Fiore ..... 206/189
2,335,022 A * 11/1943 O'Reilly ..... 206/189
3,029,977 A * 4/1962 Arneson ..... 206/179
3,198,378 A * 8/1965 Farquhar ..... 206/194
4,155,502 A * 5/1979 Forte ..... 206/194
4,196,807 A * 4/1980 Brom ..... 206/427
4,284,195 A * 8/1981 Champlin ..... 229/117.14
4,610,349 A 9/1986 Schwartz
4,948,036 A * 8/1990 Loughman ..... 229/117.14
5,158,177 A 10/1992 Negeles et al.
5,400,901 A 3/1995 Harrison
5,879,041 A * 3/1999 Sutherland ..... 206/180
6,129,266 A 10/2000 Otiff et al.
6,155,412 A 12/2000 Le Bras et al.
6,273,330 B1 8/2001 Otiff et al.
6,298,992 B1 * 10/2001 Tsao ..... 206/485
6,390,299 B1 * 5/2002 Mellon et al. ..... 229/117.15
D461,713 S 8/2002 Forman
6,571,941 B2 6/2003 Holley
6,615,985 B1 9/2003 Foreman
6,736,260 B2 5/2004 Gomes et al.
7,011,209 B2 3/2006 Sutherland et al.
7,070,045 B2 7/2006 Theelen
7,267,224 B2 9/2007 Cuomo
7,370,755 B2 5/2008 Cuomo
7,591,496 B1 * 9/2009 De Beck ..... 294/152

* cited by examiner

*Primary Examiner* — Gary Elkins
(74) *Attorney, Agent, or Firm* — Joseph K. Andonian

(57) ABSTRACT

A sling-type carrier with a two-layered handle that is connected to the panels that complete the sling in a cantilevered manner that resists tearing or separation of the handle layers.

3 Claims, 3 Drawing Sheets

HAND CARRIER

This invention relates to a product carrier with an improved integrated handle.

BACKGROUND OF INVENTION

The prior art is replete with food carriers (e.g., U.S. Pat. No. 6,615,985; U.S. D461,713), sleeve boxes (e.g., U.S. Pat. No. 6,695,985), basket-style article carriers (e.g., U.S. Pat. Nos. 5,400,901; 6,155,412; 6,571,941; 6,736,260; 7,011,209; 7,070,045; 7,267,224; 7,370,755), and cartons with handles (e.g., 6,129,266; 6,273,330). The handles on such containers are invariably straight continuations or extensions of panels that form the sides or walls of the containers. The extended panels are simply fastened together and an opening is cut into the bonded panels to act as a handhold. This arrangement puts considerable stress on the place of attachment, often leading to tearing or separation. The prevalent prior art connection between the handle and the appended sleeve for carrying a food container is best illustrated in FIG. 1 of U.S. Pat. No. 6,615,985.

BRIEF SUMMARY OF INVENTION

Disclosure of Invention

The principal object of the present invention is to provide a product carrier with a handle that is more resistant to tearing or separation.

Another object of the present invention is to provide a handhold in the handle that is stronger and also more resistant to tearing.

Other objects will become apparent in the description that follows.

It has been discovered that a cantilevered relationship between the panels or walls of the carrier and the bonded or joined panels in, the handle provide a stronger connection than a direct or straight-line connection. Thus the bonded panels in or layers of the handle of the present invention extend outward beyond the points where the sides or walls of the carrier join the handle. Thus the points of stress between the handle and the wall of the carrier are inside the lower edge of the bonded portion of the handle. This arrangement provides a connection that is stronger and less likely to tear from vertical stress or separate from stress that pulls the front panel away from the back panel. This arrangement is hereinafter designated as a "cantilevered connection".

The present invention comprises a structural design and a construction method to produce an improved product carrier with an integrated carry handle that incorporates a cantilevered structural design into the carry handle. The carry handle is bonded with adhesive or mechanically joined together so its lower region has greater length and improved structural strength to support the descending body panels at the folding joints where the adjacent areas of the unified structure are joined. The width of the body panels in commercial embodiments of the invention generally approximates that of the handle except where the body panels are connected to the handle where they are narrower than the bonded portion of the handle or even angle inward at about 15 degrees from a point at the end of the uppermost fold in the body panels. The narrower top of the body panels need only be connected to the longer lower edge of the bonded portion of the handle, preferably in centered relationship.

In its preferred embodiment the usefulness of the present carrier is enhanced by enclosing a separate product container or inner package such as a plastic thermo-formed tray and lid in the descending portion of the present carrier which acts like a sleeve or tube for the separate container. Products that are very hot or cold; products that require two hands to carry because of their shape or form; products of substantial weight or balance; or products that are delicate or fragile; all can most advantageously be carried by the product of the present invention.

The improved structural design and methods of construction of this invention have proven to be significantly stronger and capable of enduring greater lifting, handling and carrying stresses than other functionally equivalent prior art designs. The stress induced upon the handle area by the weight of product and geometry of the physical shape of the inner packages or products is transmitted from the bottom portion of the panels (when they are opened or spread out to receive a package) that receives its weight up the opposing "side panels". From the side panels it directs itself at the fold joints or area at the lowest region of the adhesively bonded or mechanically joined double thickness area of the carry handle panels. This induces opposing forces to "pull" against the adhesively bonded or mechanically joined area of the structure in a way that attempts to separate the inner surfaces of the substrate material thereby "tearing the structure apart". Once a breach is initiated, the destructive stress follows the weakened area and tears the paperboard (or a substitute material) apart starting from the end(s) of the bonded or joined area of the carry handle toward the opposite end. This can lead to product failure and cause the carried product to fall out of the carrier.

The opposing forces that can lead to product failure are modified if not eliminated by the cantilevered shape and greater length than the transverse length of the opposing descending panels. The stress is thereby distributed in both directions from the intersection of the vertical or angular edge planes of the descending opposing panels at essentially right angles to the direction of the stress, making breach of the paperboard (or other structural substrate) bond or mechanical joint nearly twice as difficult to initiate than prior art structures.

The present design has far reaching implications for any structure employing a paneled carrier with a handle connected to the panels.

The geometrical shape of the paneled handle opening (hereinafter referred to as a "handhold"), the use of finger flaps and the location of the opening in relation to the remaining portions of the handle panels are also advantageous and significant features of the present invention. The opening is located equidistant from the ends of the handle just above its adhesively or mechanically bonded panels. The center section at the bottom of the opening is a horizontal straight edge that is parallel to the top edge of the joint between the handle and the side panels and curves evenly upward at both ends at radii that are substantially greater than the radii of the curved edges adjoining both rounded ends at the top edge of the opening. The top edge of the handle opening continues downward from the rounded edges at both ends to form a rounded flap that extends downward like a tongue and fills most of the space in the midsection of the opening just above the straight edge at the bottom of the opening. The bottom edge of the opening is gondola shaped and the rounded ends on the top edge of the opening connect the ends of the gondola to the sides of the flap. The difference in the radii from the bottom edge to the top edge of the rounded ends of the opening makes the handhold stronger than the more common evenly rounded ends.

As used in this specification and claims, the word "panel" refers to the portion of the carrier that extends below the two layers of the handle. When the carrier is not opened to receive a product to be carried, a "panel" is the entire portion of the front and back of the unopened carrier below the handle. When the carrier is opened to receive a product, a front or back "panel" is that portion of the tube or sleeve thereby created that contains the window or opening. The "bottom panel" is the portion of the tube or sleeve on which the bulk of the weight of the product to be carried would rest. Most generally, as in the case of the plastic container for a rotisserie chicken, the "bottom panel" is the portion of the carrier that matches the bottom of the plastic container.

The exact shape, size and structure of the panels depends on the size and shape of the product to be placed and carried in the carrier. The container used for a rotisserie chicken is roughly shaped like a flat-bottomed bowl covered with a round lid. Panels suitable for that container have four folds each: the first where connected to the handle, the second at the top of a window in the panel, the third at the bottom of the window, and the fourth on each side of the bottom panel. There is also a fold in the midline of the bottom panel that joins the front and back panels of the unopened carrier that serves no purpose in fitting the container inside the carrier when it is opened to receive the container. The windows help to center and stabilize the container inside the sling shaped carrier.

LIST OF REFERENCE NUMERALS

Figure 1:
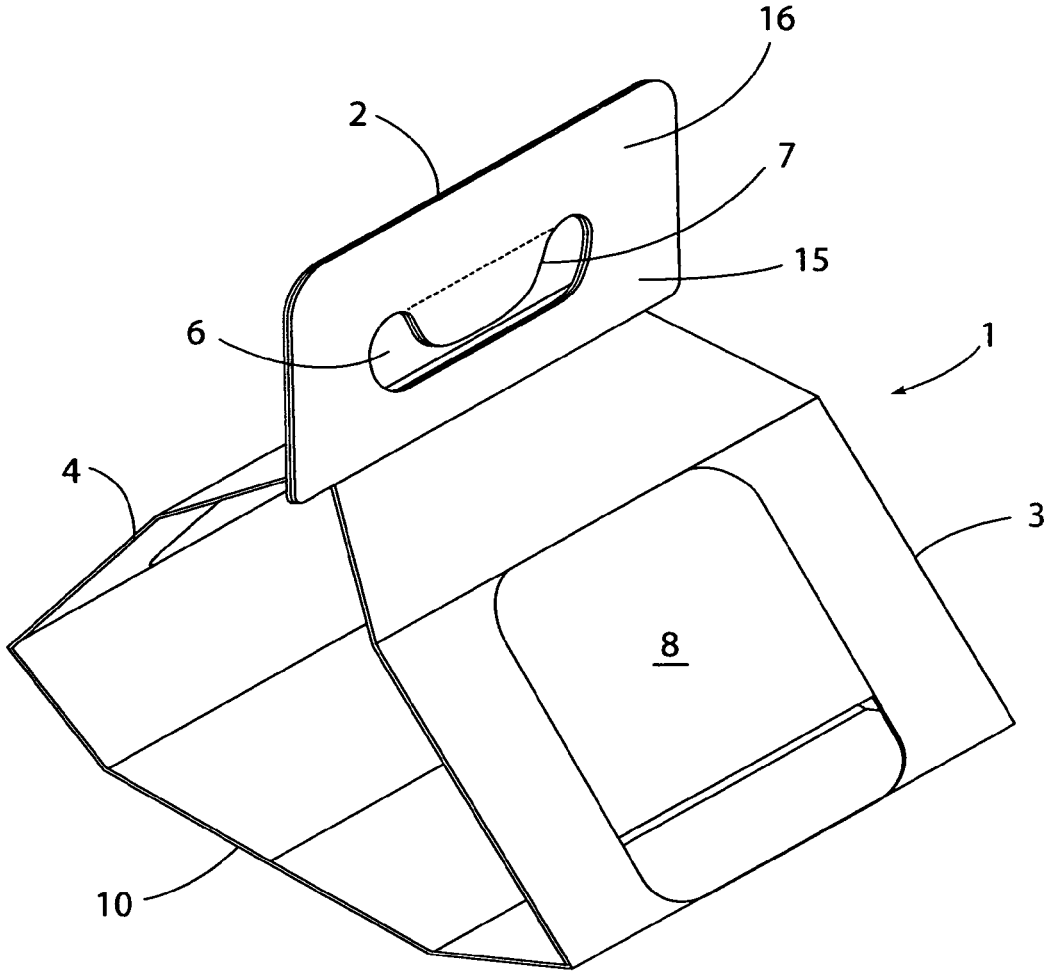
FIG. 1 is a perspective view of the product carrier ready to receive a product.

1 Perspective view of the product carrier opened to receive a product
1*a* Product carrier before folding and gluing
1*b* Front view of the product carrier before opening to receive a product
2 Handle
3 Front panel
4 Rear panel
6 Handhold
7 Flap
8 Opening in front panel
9 Opening in back panel
10 Bottom
11 Straight segment of lower edge of handhold
12*a*,12*b* Rounded ends of handhold
13*a*,13*b* Rounded ends of top edge of handhold
14*a*,14*b* Rounded ends of bottom edge of handhold
15 Lower bonded region of handle
16 Upper bonded region of handle
17*a*,17*b* Portions of the handle that extend beyond the points where the panels attach to the handle
18*a*,18*b*,18*c*,18*d*,18*e*,18*f*,18*g*,18*h*,18*i* Folds

DETAILED DISCLOSURE OF INVENTION

Best Mode of Carrying out Invention

The invention in a preferred rotisserie chicken embodiment is produced from flat sheets or rolls of paperboard of a sufficient thickness and strength to carry the weight of a plastic container and the product contained therein, and is dimensionally scaled to fit the containers geometry and size, so the product carrier in combination with the package will be properly and safely carried when in its final form and functional role.

Figure 2:
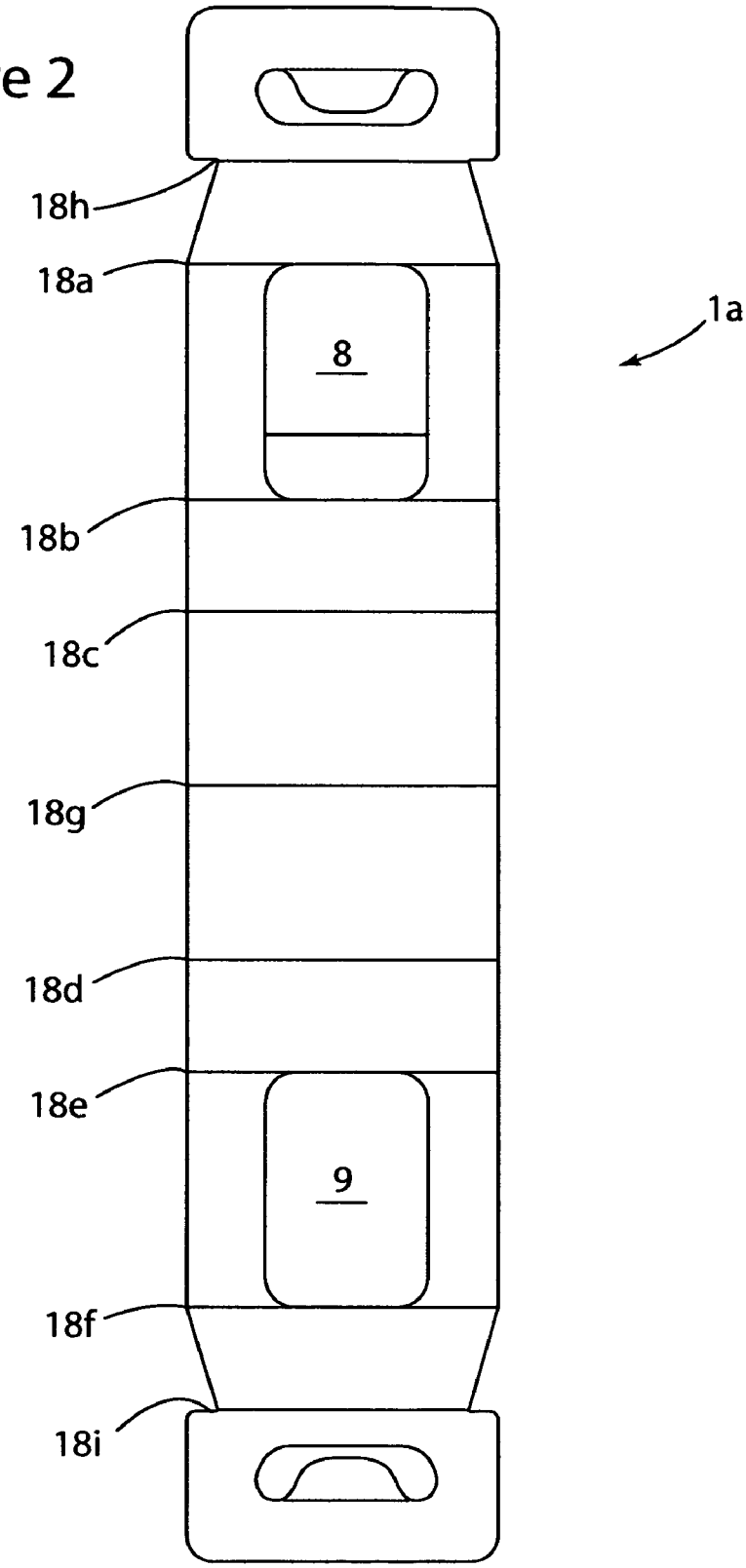
FIG. 2 is view of the carrier before it is folded and adhesive is applied to the lower and upper regions of the handle.
Figure 3:
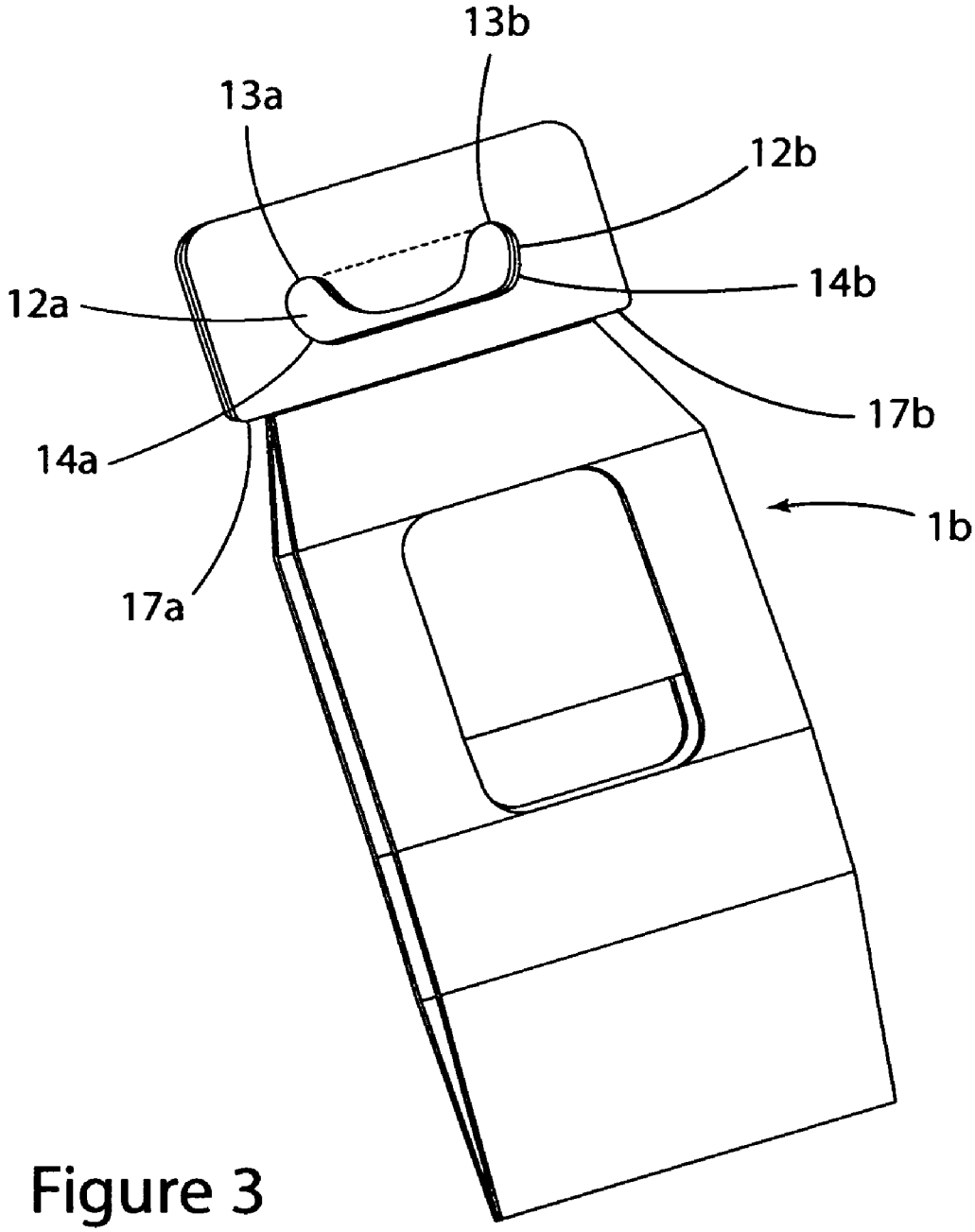
FIG. 3 is a front view of the carrier before the panels are opened to receive a product to be transported in the carrier.

FIGS. 1, 2 and 3 depict the carrier in three versions: the finished version ready to receive the container enclosing the rotisserie chicken (FIG. 1), the unfolded version (FIG. 2), and the folded and glued version before the panels are spread to receive the chicken container (FIG. 3).

The paperboard of the product carrier is typically die cut in the desired shape and dimensions from the flat sheets or rolls of paperboard, and scrap or waste is removed, then the resulting die cut piece is folded and glued in the lower region 15 between the two opposing handle panels which are joined together in a mirrored configuration so as to provide a double thickness handle 2 from which descends a contiguous circumferential open ended tube or sleeve type product carrier 1 with the carry handle 2 on the top.

The unfolded version is 25 inches long and 5 inches wide at its widest parts. The folded version is half as long and otherwise the same. The finished version is the same as the folded version except the panels 3,4 are spread apart to provide space to place the product into the carrier. The handle 2 is 5 inches wide and 2½ inches high. The lower glued region 14 of the handle 2 is ½ inch high. The handhold 6 is centered in the upper region 16 of the handle 2 just above the top edge of the lower region 15 of the handle 2. At its longest dimensions the handhold 6 is 2⅞ inches long from side to side and ⅞ inch from top to bottom. The straight segment 11 on the bottom edge of the handhold 6 curves upward at both ends 14*a*,14*b* at gradually reducing radii first to form both rounded ends 13*a*, 13*b* of the handhold 6, second to form the round ends 12*a*,12*b* of the top edge of the handhold 6, and third to proceed in the opposite direction at increasing radii until they join to complete the flap 7 at a point that is 3/16 of an inch above the midpoint of the straight segment 11 of the lower edge of the handhold 6. The front and rear panels 3,4 are each connected to the lower region 15 of the handle 2 at a point that is ½ inch from each side of the handle 2. The straight segment 11 of the lower edge of the handhold 6 adjoins the top edge of the lower region 15 of the handle 2.

When erected the carrier 1 is capable of receiving a plastic container (not shown) by pushing the container through one end of the open tube aperture formed by spreading the panels apart until the plastic package resides in a balanced arrangement inside the product carrier 1. The product carrier 1 is designed and constructed to fit snuggly geometrically around the three dimensional plastic container which is in turn designed to contain a particular product such as a rotisserie chicken. The preferred product carrier 1 is designed and fabricated so its flat planar panels provide embossed fold joints 18*a*,18*b*,18*c*,18*d*,18*e*,18*f*,18*g*,18*h*,18*i* best depicted in FIG. 2, which, when opened and erected into the shape required to receive the plastic container containing a rotisserie chicken, fits snuggly over the plastic container and will structurally bear and distribute the combined weight of the finished product with very little stress and deformation when picked up, carried and subjected to stresses such as swaying, shaking, bumping into objects, and the like that may take place during ordinary usage.

The preferred method of fabrication for the rotisserie chicken carrier is to begin with rolls or sheets of Solid Unbleached Sulfate or Carrier Grade paperboard of between 0.016" and 0.028" nominal thickness, of which the white clay coated side is printed by means of a printing device such as an offset printing press with decorative graphics and textual product information, UPC code and the like. The preferred embodiment includes an advertisement, coupon, or promotional information printed and attached with a perforated connection in one or more window or opening 8,9 in a panel 3,4. Following the printing process the rolls or sheets are embossed and cut to fit each particular plastic container for which the product carrier is to be used. The commercially available die cutting machine used for this purpose is available worldwide to perform the same embossing and cutting functions for production of folding cartons for other food and hard good products sold commercially.

The rolls or sheets may contain multiple unfolded product carriers 1*a* arranged in parallel arrays in such a way as to use the available area of a printing press and die cutting machinery efficiently. As such, a continuous repeating consecutive printing of parallel arrays of unfolded product carriers 1*a* on a roll are die cut and the fold areas 18*a*,18*b*,18*c*,18*d*,18*e*,18*f*,18*g*,18*h*,18*i* embossed, the unfolded product carriers 1*a* are separated from the scrap or waste material which must be removed so that only the flat die cut and embossed shape remains. The unfolded product carriers 1*a* are collected by mechanical and/or human means, and may be stacked on pallets or other means of conveying them to a folding and gluing operation. Piles of sheets (as opposed to rolls) are similarly processed consecutively one at a time by means of a die cutting machine and collected again into piles of die cut embossed sheets with much or all of the scrap or waste material removed during the die cutting process. This operation is typically performed at high speeds of up to 12,000 sheets per hour in current state of the art die cutting machinery.

The foldable areas 18*a*,18*b*,18*c*,18*d*,18*e*,18*f*,18*g*,18*h*,18*i* are straight embossments, the paperboard being supported on a form in the die cutting machine that has voids on the lower supporting surface. The width and depth of the voids are suitable for a steel embossing tool (typically called a "scoring rule") to push against the top surface of the paperboard and force the intended embossment to occur by compressing the paperboard into the void area. The embossed area is thereby weakened enough to fold mechanically when physical force is applied to the flat surfaces adjacent to each such embossed "scored" area. The bottom score 18*g* will be folded during the folding and gluing process, and the others 18*a*,18*b*,18*c*,18*d*,18*e*,18*f*,18*h*,18*i* will be folded by the retail store or company that assembles the rotisserie chicken, plastic container and product carrier into their final retail presentation form. The bottom 10 of the carrier 1 is defined by the area between folds 18*f* and 18*h*.

Once the unfolded product carriers 1*a* are die cut and embossed, and waste or scrap material is removed, they are typically processed by a folding & gluing machine like that used commercially worldwide by printers and folding carton companies to fold and glue other folded cartons like cereal and cracker packages.

Each die cut and embossed flat piece 1*a* is typically separated by the mechanical feeding component of the folding and gluing machine and consecutively conveyed in a straight line parallel to the embossed fold areas for typically 15 to 50 feet on motor powered belted conveyers. Top belts and pressure rolls maintain physical pressure sufficient to hold the product carriers 1*a* tightly on the conveyers through a series of folding devices that apply lifting and bending pressure in opposite directions to the embossments so they will fold like a hinge. Each unfolded product carrier 1*a* is also consecutively conveyed through a gluing station where glue will be applied in stripes either mechanically or electronically onto the areas in sufficient amounts to provide the desired structural strength to the product carrier. Following application of glue, the product carrier 1*a* is essentially folded in half to form a product carrier 1*b* that is basically two mirrored halves joined back to back by glue in lower region 15 of the carry handle 2 and a single fold 18*g* at the opposite end of the structure before the panels 3,4 are separated to form the tube below folds 18*h*,18*i* to receive a package.

The specific dimensions and materials for the preferred embodiment described are appropriate for a rotisserie chicken but are not in any way critical to the present invention. With different materials and dimensions the carrier of the present invention can be employed to carry many different shapes, weights and sizes of products.

The foregoing provides a general description and a preferred embodiment of the present invention. It should be understood the various substitutions, variations and modifications can be made by those skilled in the art without departing from the spirit and scope of the invention as further delineated in the following claims.

The invention claimed is:

1. A combination adapted to carry products by hand in a sling-like carrier comprising a substantially rectangular handle having an upper region and a lower region, a top layer and a bottom layer that are mirror images of each other, each layer having a straight lower edge, and a substantially rectangular front panel and a substantially rectangular rear panel that are mirror images of each other, each panel having a straight upper edge and a straight lower edge, the upper edges being shorter than both lower edges of the handle layers, and wherein the top layer and the bottom layer of the handle are adhesively bonded or mechanically connected to each other in the lower region of the handle, said adhesive bond or mechanical connection extending along and laterally beyond where the top layer and bottom layer contact the front and rear panels along the straight lower edges, extending beyond where they contact the front and rear panels, a handhold is centered in and cut into the upper region of the handle, the shorter upper edge of the front panel is centered under and connected to the lower edge of the top layer of the handle, the shorter upper edge of the rear panel is centered under and connected to the lower edge of the bottom layer of the handle, the upper edges of the front and rear panels are in direct contact with the bonding adhesive or mechanism that connects the handle layers, and the lower edges of the front and rear panels are connected to each other to complete the sling-like configuration of the carrier when the front and rear panels are spread apart.

2. The carrier of claim 1 further comprising a handhold with an opening having a bottom edge, a top edge, and rounded ends, the bottom edge having a gondola shape with a substantially straight center section that rounds evenly upwards at both ends, the top edge having rounded ends connected to a tongue shaped center flap that extends and rounds downward in the opposite direction from the rounded ends of the top edge into the opening, the ends of the lower edge being rounded at a greater radii than the ends of the upper edge as they join together to form the rounded ends of the opening.

3. The hand carrier of claim 1 having windows in the front and back panels of the carrier in which windows advertising coupons can be appended in easily detachable form.

* * * * *